US007044142B2

(12) United States Patent
Gueret

(10) Patent No.: US 7,044,142 B2
(45) Date of Patent: May 16, 2006

(54) UNIT FOR APPLYING AT LEAST ONE PRODUCT

(75) Inventor: Jean-Louis H. Gueret, Paris (FR)

(73) Assignee: L'Oréal, S.A., Paris (FR)

( * ) Notice: Subject to any disclaimer, the term of this patent is extended or adjusted under 35 U.S.C. 154(b) by 393 days.

(21) Appl. No.: 10/114,449

(22) Filed: Apr. 3, 2002

(65) Prior Publication Data

US 2002/0144702 A1 Oct. 10, 2002

(30) Foreign Application Priority Data

Apr. 3, 2001 (FR) ..... 01 04507

(51) Int. Cl.
*A45D 40/24* (2006.01)
*A45D 40/26* (2006.01)

(52) U.S. Cl. ..... 132/317; 132/305; 132/314; 132/316; 132/216

(58) Field of Classification Search ..... 132/317, 132/320, 73–73.5, 75, 293, 301, 304–305, 132/314–316, 294, 296, 216; 401/126–130, 401/118, 8; D28/4, 56; D9/516, 526; 215/382
See application file for complete search history.

(56) References Cited

U.S. PATENT DOCUMENTS 2,296,139 A * 9/1942 Blair ..... 434/100
3,060,942 A * 10/1962 Finlay ..... 401/129
D198,288 S * 5/1964 Johns ..... D9/526
4,428,388 A * 1/1984 Cassai et al. ..... 132/218
4,458,701 A 7/1984 Holland
4,717,024 A * 1/1988 Djezovic ..... 206/581
D305,406 S * 1/1990 Thune ..... D9/526
5,476,194 A * 12/1995 Hippely et al. ..... 222/192
D386,086 S * 11/1997 Kotoucek ..... D9/526
6,062,229 A * 5/2000 Kandratavich et al. .... 132/73.6
6,120,202 A * 9/2000 Donsky ..... 401/35
6,126,349 A * 10/2000 Kelders ..... 401/36
6,309,125 B1 * 10/2001 Peters ..... 401/127
6,694,987 B1 * 2/2004 Thiebaut ..... 132/297

FOREIGN PATENT DOCUMENTS

DE 199 18 587 11/2000
FR 2 647 009 11/1990
GB 2 235 861 3/1991
WO WO 9831252 A1 * 7/1998

* cited by examiner

*Primary Examiner*—Kevin Shaver
*Assistant Examiner*—Stephanie L. Willatt
(74) *Attorney, Agent, or Firm*—Finnegan Henderson Farabow Garrett & Dunner, L.L.P.

(57) ABSTRACT

A unit for applying at least one product comprises a container defining a longitudinal axis curved over at least a portion of its length so that at least a portion of the axis defines at least one curve. The container comprises an interior and an opening. The unit further comprises a cap configured to seal the opening, a flexible stem, and an applicator member at an end of the flexible stem. The applicator member is removably arranged in the interior of the container and is accessible via the opening.

87 Claims, 5 Drawing Sheets

Fig. 4D
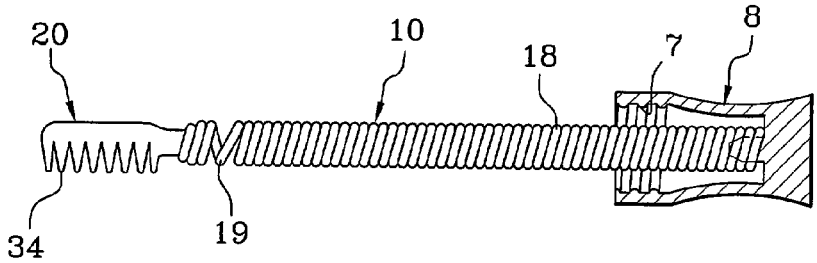
Fig. 4E
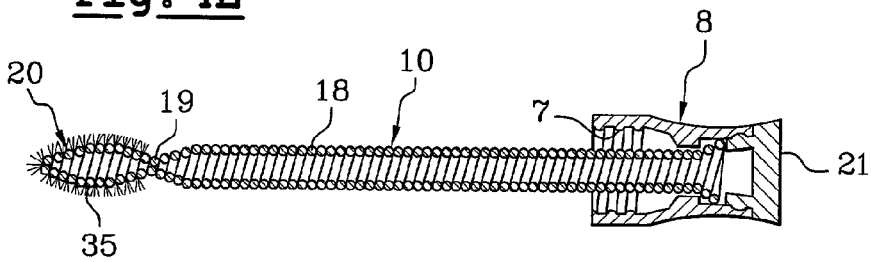
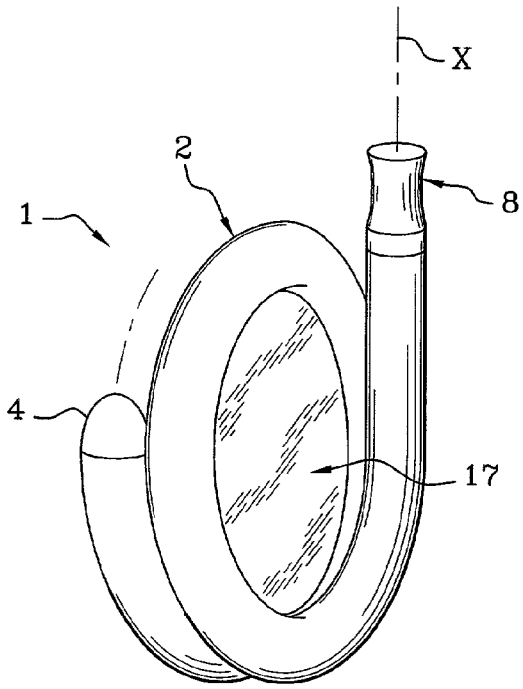
Fig. 5

UNIT FOR APPLYING AT LEAST ONE PRODUCT

The present invention relates to a unit for applying at least one product. The at least one product may be chosen from cosmetic products, care products, and hygiene products. Examples of products that may be used include products for the skin, the hair, the nails, the eyelashes, and/or the eyebrows. Such products may include mascara, nail varnish, eye shadow, eye liner, cream, blush, powder and/or lip make-up.

Conventionally, many of these products are packaged in a unit comprising a straight cylindrical container, generally of small cross-section with respect to its height. Such containers comprise an opening through which an applicator member formed at the end of a stem is inserted so as to be brought into contact with the product in the container. Upon introduction into the container, and upon extraction, the applicator member may be made to pass through a wiping member arranged near the opening and intended to meter the amount of product present on the applicator member.

One disadvantage of conventional devices relates to the lengthwise bulk of these packaging and application units. The bulk of these units is dictated by the need to have an applicator stem that is long enough to allow the product to be applied properly, particularly in the case of a product that is applied to the eyelashes or eyebrows.

Other disadvantages relate to difficulties in loading the applicator member with a product and to the accessibility of the product by the applicator member, particularly with respect to the product near the walls of the container. These problems are even more apparent where the product is highly viscous.

One of the aspects of the present invention relates to an application unit that may have a reduced lengthwise bulk while optionally not having an applicator stem having a reduced length.

Another aspect relates to a unit that may allow the applicator member to become well laden with product.

A further aspect relates to a unit that may more easily allow complete or almost complete use of the product it contains.

A still further aspect of the invention relates to a unit that may have a novel appearance, be simple to use, and be economical to produce.

Yet another aspect relates to a unit that may allow advantageous application of a product, such as, for example, gentleness and precision in application of the product.

Other aspects will become apparent in the following description. It should be understood that the invention, in its broadest sense, could be practiced without having one or more of the aspects described herein.

According to an aspect of the invention, a unit for applying at least one product may comprise a container defining a longitudinal axis curved over at least a portion of its length so that at least a portion of the axis defines at least one curve. The container may comprise an interior and an opening. The unit may further comprise a cap configured to seal the opening, a flexible stem, and an applicator member at an end of the flexible stem. The applicator member may be removably arranged in the interior of the container and may be accessible via the opening.

The shape of the curve defined by the axis may vary considerably. According to one aspect, the curve may be a loop or a portion of a loop with a uniform radius of curvature. Thus, the curvature of the axis may be substantially constant along the length of the axis.

In another aspect, the curve may be formed from a succession of circular arc portions with radii that change in one direction and/or another. Thus, the curvature of the axis may vary along the length of the axis. In a further aspect, the curvature of the axis may comprise at least one progressive profile. The curve may also be a loop or portion of a loop in the shape of an ellipse or oval. It may also be a loop or a portion of a loop formed from a succession of straight portions at angles to one another, such as a pentagon, a hexagon, or an octagon. A different number of straight portions may also be used to form loops having other shapes. The loop or loop portion may lie in one plane or may have an axial component so as to form a helix or a portion of a helix.

In an exemplary embodiment, the curved container may have at least two sections transverse to the axis and contained in the same plane.

In one aspect of the invention, the shape of the curve may be chosen according to the dimensions of the applicator, which may be flexible, and according to the flexibility of the stem, so that the applicator member formed at the end of the stem may be easily inserted into and extracted from the container along the path defined by the shape of the curve. A continuous curve may be used In a further aspect, the curved shape of the container may provide a unit which is more compact, and therefore takes up less space than conventional straight units.

In an exemplary embodiment, the stem may be removably arranged in the interior of the container. In a further exemplary embodiment, the flexibility of the stem may allow the stem to revert to a substantially straightened shape when the applicator member is removed from the container. The stem may retain a slightly curved shape, which may prove useful when applying the product, and which may furthermore make the applicator member easier to put back into the container.

According to an exemplary embodiment, the unit may comprise at least one product in the container. In a further exemplary embodiment, the at least one product may be chosen from cosmetic products, care products, and hygiene products.

According to another exemplary embodiment, the cap may be removably mounted to the container. In a further exemplary embodiment, the cap may be removably mounted to the container by one of snap-fastening, screw-fastening, and a system involving ramps.

In an exemplary embodiment, the cap may be configured to cover the opening. In a further exemplary embodiment, the cap may be configured to seal the opening to prevent leakage of product from the container.

In yet another exemplary embodiment, the cap may be opened by a rotational movement, for example, by screwing and unscrewing. In a further exemplary embodiment, the unit may be configured so that the applicator member contacts an inner surface of the container during rotational movement of the stem. For example, the rotational movement of the stem may give rise to a helical movement of the applicator member at the end of the stem and may cause the applicator member to engage the walls of the container. This may result in a "sweeping off" of the walls of the container by the applicator member and better impregnation of the applicator member with the product. This may be particularly desired at the end of the use of the unit.

In a further exemplary embodiment, the stem may be rigid enough to overcome the resistance encountered by the applicator member upon introduction of the applicator member into the container. The resistance on the applicator member may result from the curved shape of the container. Containers having greater curvature may provide higher resistance on the applicator member.

According to an aspect of the invention, the shape of the container may make it possible to use a stem having the same or greater length than those used with conventional units. In the case of a unit for applying a make-up product, such an increased length may make application of the make-up easier.

In a further aspect, the elasticity of the stem may make it possible to obtain better lengthening and better curling of the lashes, for example, in the case where the make-up product is a product for applying make-up to the eyelashes.

Optionally, in the case of an eye shadow or of a lip make-up, this elasticity may improve the gentleness of application by reducing the pressure exerted on the surface that is to be treated. This pressure may be a source of irregularities in the application of the make-up. In the case of a nail varnish, the elasticity may allow a thicker, more uniform, and brighter coat to be applied.

In an exemplary embodiment, the curve defined by the axis may lie substantially in a plane. In a further exemplary embodiment, the curve may extend over an interval ranging from one-fourth of a full turn to three full turns. In a still further exemplary embodiment, the curve may extend over an interval ranging from one-half of a full turn to one and a half turns.

In another exemplary embodiment, the curve may define at least a portion of a helix. In a further exemplary embodiment, the curve may extend over at least one-half of a full turn. In a still further exemplary embodiment, the curve may extend over at least one full turn.

In an exemplary embodiment, when the container has an at least partially annular or helicoid configuration, planar or otherwise, a user may wear the container in the manner of a bracelet.

In an exemplary embodiment of the invention, the unit may further comprise a mirror associated with the container. In one exemplary embodiment, the mirror may be located inside the curve defined by the axis of the container. Thus, in the case of a container of annular shape, the mirror may be attached directly to the container. Alternatively, the mirror may be arranged on one side of a wall extending inside the internal annular edge of the container. The other side of the wall may be used for graphical images relating to the product, such as, for example, a trade name, logo, and/or composition information. Such a wall may be molded in with the rest of the container or may be formed of an attached part. The attached part may be attached by a method chosen from snap-fastening, bonding, and welding.

In a further exemplary embodiment, the container may comprise a first container and the unit may further comprise an auxiliary container associated with the first container. The auxiliary container may be located inside the curve defined by the axis of the first container. Further, the auxiliary container may be removably mounted to the first container or permanently mounted to the first container.

In a still further exemplary embodiment, the unit may further comprise a mirror mounted on the first container. In another exemplary embodiment, the unit may further comprise a mirror mounted on the auxiliary container.

In a further exemplary embodiment, the unit may further comprise at least one product in the auxiliary container. The at least one product may be chosen from cosmetic products, care products, and hygiene products. In another exemplary embodiment, the unit may further comprise at least one product in the first container, wherein the at least one product in the auxiliary container differs from the product in the first container. For example, the first container may contain mascara, while the auxiliary container may contain lip make-up, nail varnish, cream, and/or blush. In yet another exemplary embodiment, the unit may further comprise at least one product in the first container, wherein the at least one product in the auxiliary container is identical to the product in the first container.

According to an aspect of the invention, the auxiliary container may also be of curved shape, particularly complementing that of the main container. Thus, in a unit in the form of about one turn (e.g., about 360°) of a helical structure, a first container may form one half turn and the other may form the other half turn with the bottom of each of the containers facing each other.

In a further exemplary embodiment, the unit may comprise a wiping member mounted near (e.g., at or adjacent to) the opening. The wiping member may interact with the applicator member at least when the applicator member is withdrawn from the interior of the container.

Optionally, the wiping member may comprise an annular element. In an exemplary embodiment, the annular element may have an interior cross-section that is smaller than a maximum cross-section of the applicator member. In another exemplary embodiment, the wiping member may comprise a material chosen from thermoplastic materials, elastomeric materials, and foam materials.

In yet another exemplary embodiment, the applicator member may be secured to a first end of the stem and the cap may be secured to a second end of the stem opposite to the first end.

According to an exemplary embodiment, at least a portion of the stem may be configured in the form of a helical spring. Such a spring may be made of metal or of a thermoplastic. Configuring the stem in the form of a spring may make it possible to reduce the pistoning effect when the stem is passed through the wiping member by allowing air to circulate between the turns.

According to a further exemplary embodiment, at least a portion of the stem may have contiguous turns. Such contiguous turns may reduce the visible soiling of the stem. A spring such as this may have one or more portions in which the turns are not contiguous to give the stem regions where it is encouraged to deform. This feature may be desired, such as, for example, when applying the product.

According to a still further exemplary embodiment, the stem may comprise a metal element. In another exemplary embodiment, the stem may further comprise a tubular element and the metal element may be inside the tubular element. In one exemplary embodiment, the metal element may comprise metal wire. Optionally, the tubular element may comprise a thermoplastic material, such as, for example, polyethylene. Other materials may also be used.

In yet another exemplary embodiment, the stem may comprise a solid element. Optionally, the solid element may comprise a thermoplastic material, such as, for example, polyethylene. Other materials may also be used.

In a still further exemplary embodiment, the stem may be hollow.

In a further exemplary embodiment, the stem has at least one region of greater flexibility proximate to the applicator member. In the at least one region, the flexibility of the stem may be greater than its flexibility over the remainder of its length. The stresses exerted on the applicator member upon contact with the product inside the container may be thus limited.

In one aspect of the invention, when the stem is in the form of a spring, the region of greatest flexibility may result from a smaller cross section of the spring near the applicator, and/or from the presence of one or more non-contiguous turns near the applicator.

In a further exemplary embodiment, the applicator member may comprise flocking. In another exemplary embodiment, the applicator member may comprise at least one of a paintbrush-type brush, a bottle-type brush (e.g., a brush including bristle ends extending substantially radially from a core), an applicator comb, a molded element, a spring, a felt element, a sintered material, and a threaded shank. The sintered material may be chosen from thermoplastics and ceramics. In yet another exemplary embodiment, the applicator member may have reliefs formed on its surface. The reliefs may be chosen from the striation type and the diamond-tip type.

In an exemplary embodiment, the applicator member may comprise foam.

In another exemplary embodiment, the applicator member may comprise a brush comprising a twisted wire core.

In an exemplary embodiment, the applicator member may comprise a helical spring formed as a continuation of the stem. The applicator member of this embodiment may have contiguous or non-contiguous turns. In a further exemplary embodiment, the stem itself may comprise a helical spring. Optionally, the applicator spring may be separated from a spring that forms the stem by a connecting region comprising one or more non-contiguous turns or a succession of turns of smaller cross section. The applicator spring may be flocked.

According to an aspect of the invention, the applicator member may comprise a material chosen from plastic, wood, and metal. Optionally, the applicator member may be obtained by a method chosen from molding, cutting, and pressing.

In an exemplary embodiment, the container may be formed by a method chosen from extrusion, blow-molding, machining, injection-molding, thermoforming, and molding. In another exemplary embodiment, the container may be formed as a unitary part. In yet another exemplary embodiment, the container may be formed as a multi-component part.

In a further exemplary embodiment, the container may comprise a thermoplastic material. Optionally, the thermoplastic material may be chosen from polyethylenes, polyvinyl chlorides, polyethylene terephthalates, polyamides, polyesters, and polystyrenes. In a still further exemplary embodiment, the container may comprise an attached bottom and an attached neck and the opening may be defined by a free edge of the attached neck.

In one aspect, the container may be extruded in the form of an open tube. One of the ends may be sealed by an attached bottom and the other end may be provided with an attached neck configured to receive the cap optionally equipped with the stem and the applicator member.

In an exemplary embodiment, the interior of the container may comprise a longitudinal axis at least substantially the same as said longitudinal axis of the container. In a further exemplary embodiment, the interior may have a generally tubular shape comprising at least one curve. In a still further exemplary embodiment, at least a portion of an exterior surface of the container may have a generally tubular shape comprising at least one curve.

In another aspect, a method of applying product may comprise providing a unit for applying at least one product, loading the applicator member with product, and placing the loaded applicator member in contact with at least one of skin, hair, a finger nail, a toe nail, eyelashes, and eyebrows so as to apply product thereto. The loading may comprise loading the applicator member with at least one of lip make-up, mascara, eye shadow, eye liner, nail varnish, cream, blush, and powder.

The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

In yet another aspect, the method may further comprise wiping the applicator member with a wiping member. Optionally, the method may further comprise placing the applicator member in contact with an inner surface of the container.

In a further aspect, the method may further comprise removing the applicator member from the container, wherein the stem returns from a curved shape to a substantially straightened shape during the applicator member removal. In a still further aspect, the method may further comprise inserting the applicator member into the container, wherein the stem becomes curved during the inserting.

The accompanying drawings are included to provide a further understanding of certain aspects of the invention and are incorporated in and constitute part of the specification.

FIGS. 4A–4E are plan views of several exemplary embodiments of an applicator subassembly;

FIG. 5 is a perspective view of the unit according to another exemplary embodiment of the invention;

Figure 1:
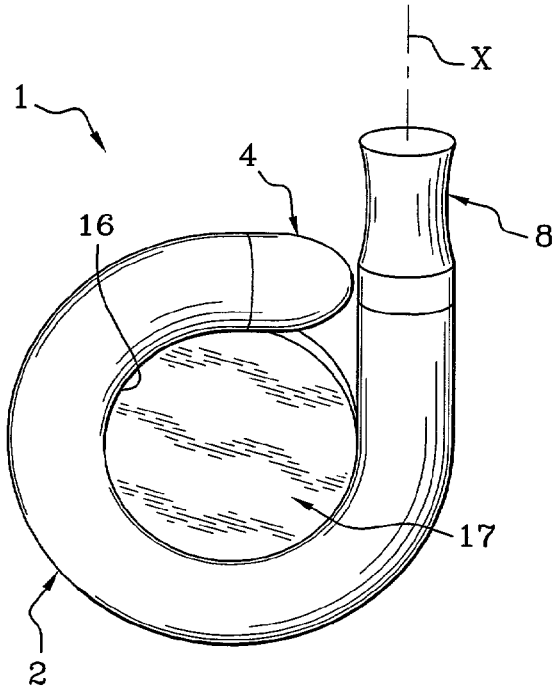
FIG. 1 is a perspective view of the unit according to an exemplary embodiment of the invention.
Figure 2:
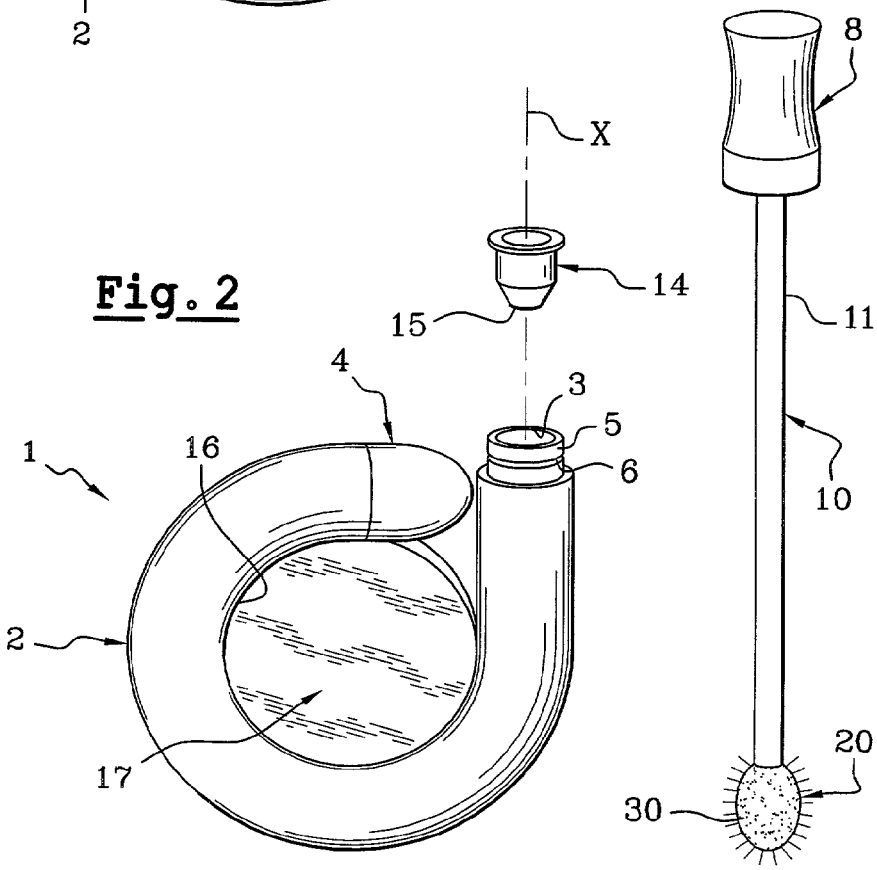
FIG. 2 is an exploded view of the unit of FIG. 1.
Figure 3:
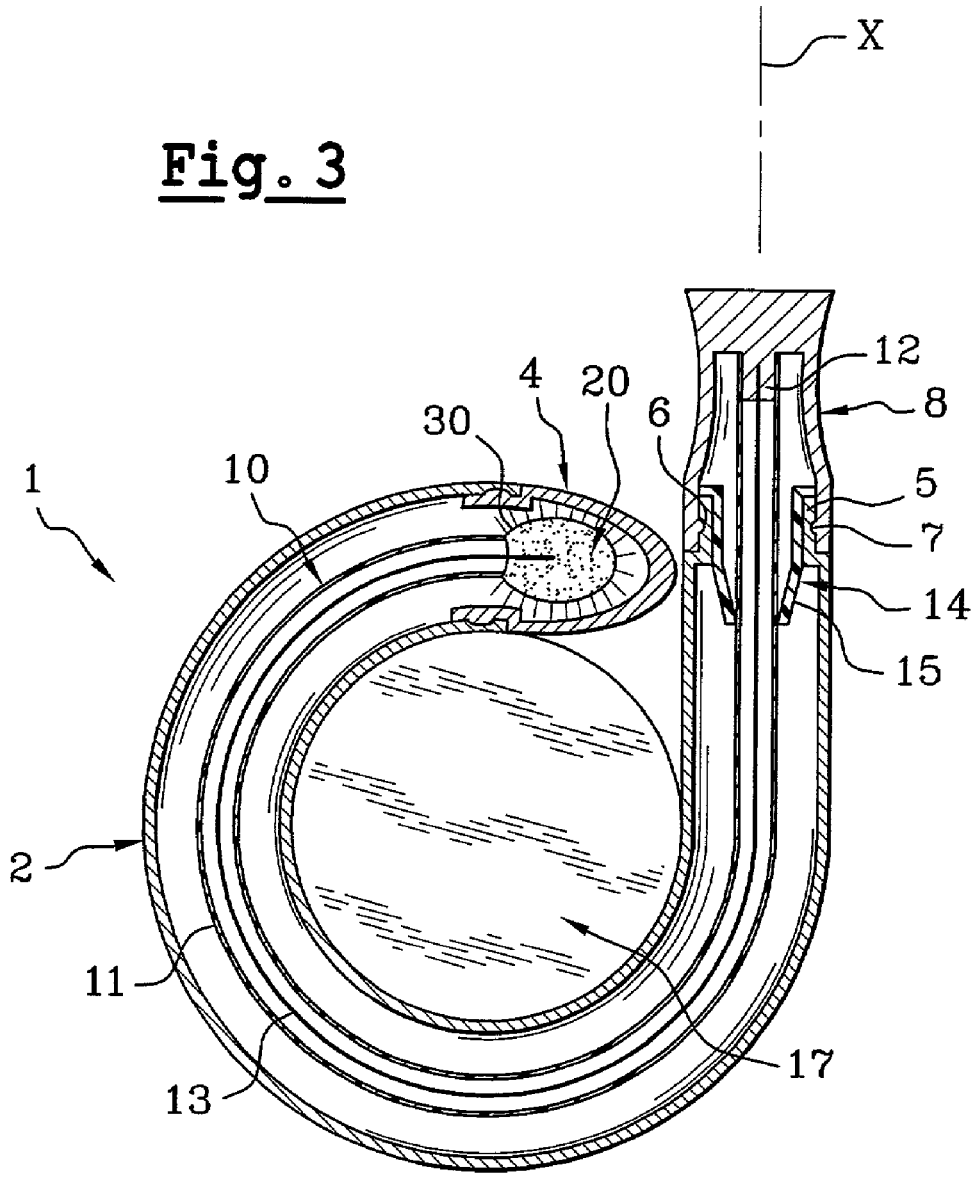
FIG. 3 is a cross-sectional view of the unit of FIG. 1.

In the embodiment of FIGS. 1–3, the application unit 1 comprises a container 2 defining an axis X. The container 2 extends between an opening 3 and an attached bottom 4, located approximately at the same level as the opening 3. The container 2 is formed from an extruded tube.

Between the opening 3 and the bottom 4, the container 2 forms a loop extending over about 360°.

A wall is formed substantially in the longitudinal plane of the unit 1. The wall is arranged on the inside of the interior annular edge 16 of the container 2. A mirror 17 is bonded to one side of the wall. Technical and/or commercial information relating to the product in the container may be affixed to the other side of the wall. This information may include graphical images relating to the product, such as, for example, a trade name, logo, and/or composition information.

The opening 3 is delimited by the free edge of an attached neck 5, the exterior surface of which has a screw thread 6 configured to engage a corresponding screw thread 7 provided on the interior surface of a cap 8. The cap 8 is secured to a flexible stem 10, to the end of which is fixed an applicator member 20 in the form of a block of foam 30. The product contained in the container 2 may be a relatively liquid composition for the lips.

The flexible stem 10 comprises a hollow stem made of low density polyethylene 11, one end of which is force-fitted onto a protrusion 12 formed along the axis of the cap 8. The other end of the hollow stem 11 is secured to the block of foam 30. Extending along inside the hollow stem 11, over roughly its entire length, is a thin steel rod 13, configured to give the stem 10 elasticity and resilience. The thin steel rod may comprise piano wire or other resilient materials.

A wiping member 14 is mounted fixedly, such as with a press fit, in the neck 5 of the container. The wiping member 14 comprises an annular lip 15, having an interior cross-section smaller than the maximum cross-section of the applicator member 20.

When the cap 8 is in the fitted position, as depicted in the sectional view of FIG. 3, the stem 10 more or less follows the curvature of the axis X of the container. The applicator member 20 is approximately near the bottom 4 of the container 2.

To use the device according to this embodiment, the user unscrews the cap 8. In doing so, she turns the rod 10 and the applicator member 20 fixed to the end of the stem. During this unscrewing movement, the applicator 20 rubs against the interior walls of the container, following a roughly helical path. Once the screw threads 6 and 7 disengage, the user pulls the cap 8 to extract the applicator member 20 from the container. As it nears the opening, the applicator member 20 passes through the wiping member 14, where excess product may be removed.

Once the applicator member 20 has been fully extracted, the stem 10 returns to a more or less straight configuration, as shown in FIG. 2. The product can then be applied in the conventional way. The elasticity of the stem may provide a gentle touch to application to the lips.

After use, the user introduces the applicator member 20 into the container 2. The applicator member 20 passes once again through the lip 15 of the wiping member 14 and is guided towards the bottom 4 by the curved walls of the container 2. The stem 10 is rigid enough to push the applicator member 20 towards the bottom, but flexible enough to conform to the shape of the container. The introduction movement continues until the screw thread 6 of the neck 5 of the container engages with the screw thread 7 of the cap 8. At that moment, the cap 8 is turned with respect to the container 2 so as to seal the container. During this rotational movement of turning, the applicator member 20 is once again in contact with the interior walls of the container 2 and follows a helical path, which is the reverse of the movement it had when the container 2 was being opened.

FIGS. 4A–4E, to which reference is now made, illustrate several alternative embodiments of an applicator subassembly comprising the cap 8, the stem 10, and the applicator member 20.

Figure 4A:
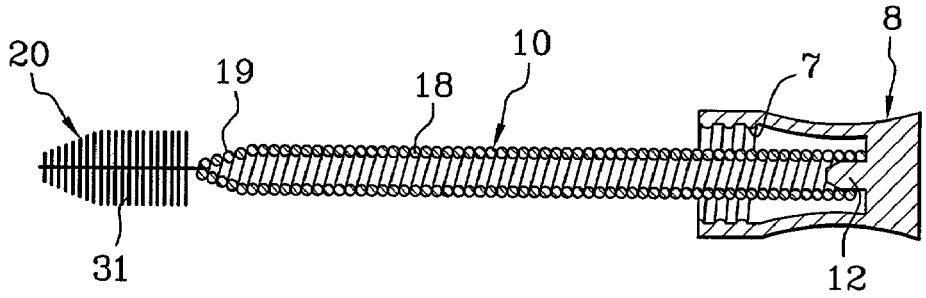

According to the alternative form of FIG. 4A, the applicator member 20 is in the form of a twisted-type mascara brush 31. In the twisted-type brush, ends of bristle elements extend substantially radially from a central core. The flexible stem 10 is formed of a spring 18 with contiguous turns, the cross-section of which is roughly constant over most of its length, and which ends in an end region 19, the cross-section of which diminishes progressively towards the applicator member 20. This region 19 of increased flexibility may make it possible to limit the stresses experienced by the applicator member 20 in contact with the product inside the container 2, particularly during opening and closing.

When the applicator member 20 is extracted in preparation for use, and when it is returned to the container after use, the components of the device interact as in the previous embodiment. On application of the product, the elasticity of the flexible stem 10 may make it possible to obtain better lengthening and better curling of the lashes.

Figure 4B:
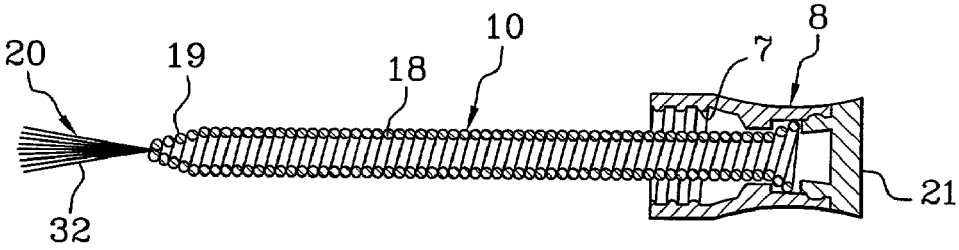

In the alternative form of FIG. 4B, the applicator member 20 is a paintbrush-type brush 32, the bristles of which are roughly parallel to the axis of the stem 10. According to this embodiment, the stem 10 is mounted on the cap 8 through an open end. Once the stem 10 has been introduced, a stopper 21 is clipped over the open end of the cap 8. The product to be applied may be a nail varnish. Other products may also be applied with the paintbrush-type brush 32.

When the applicator member 20 is extracted for use, and when it is returned to the container after use, the components of the device interact as in the embodiments described previously. On application of the product, the elasticity of the flexible stem 10 may make it possible to limit the pressure exerted by the brush 32 on the product in contact with the nail. This feature may make it possible to apply a thicker and more uniform coat of product.

Figure 4C:
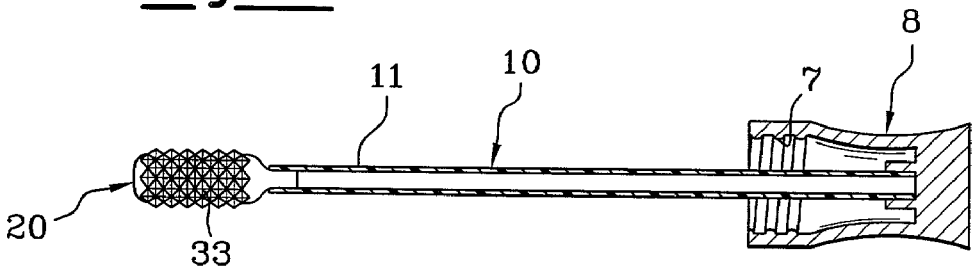

The subassembly in FIG. 4C differs from the embodiment of FIGS. 1–3 in that the flexible stem 10 comprises a hollow propylene stem 11. Furthermore, the applicator member 20 comprises a thermoplastic structure 33, the surface of which has reliefs in the form of diamond tips.

The embodiment of FIG. 4D differs from the embodiment of FIG. 4A in that the applicator member 20 comprises an applicator comb 34 having an arrangement of teeth. Such a comb may be obtained by molding a material, such as a polyethylene. Other materials and processes may be used. Such an applicator may be particularly suitable for applying mascara to the eyelashes or eyebrows. According to this embodiment, the region 19 of increased flexibility comprises one or more non-contiguous turns arranged near the applicator comb 34.

The embodiment of FIG. 4E differs from the embodiment of FIG. 4B in that the applicator member 20 comprises a spring with contiguous turns 35, the surface of which is flocked. The flocking may comprise nylon, rayon, and/or cotton fibers. Other materials may also be used. Such an applicator 35 may be well suited to the application of mascara to the eyelashes or eyebrows. According to this embodiment, the flexible stem 10 also comprises a helical spring with contiguous turns 18. The applicator spring 35 is separated from the stem by a portion 19 also configured in the form of a helical spring with contiguous turns but of a smaller cross-section than the cross-section of the stem 18 and of the applicator spring 35. The stem 18, the connecting region 19, and the applicator spring 35 are formed as a single piece.

In the embodiment illustrated in FIG. 5, the curved axis X of the container 2 extends, not in one plane as it did in the embodiment of FIGS. 1–3, but in a helix extending over about one and a half turns. The operation of the unit 1 according to this embodiment is similar to that discussed with reference to the previous embodiments.

Figure 6A:
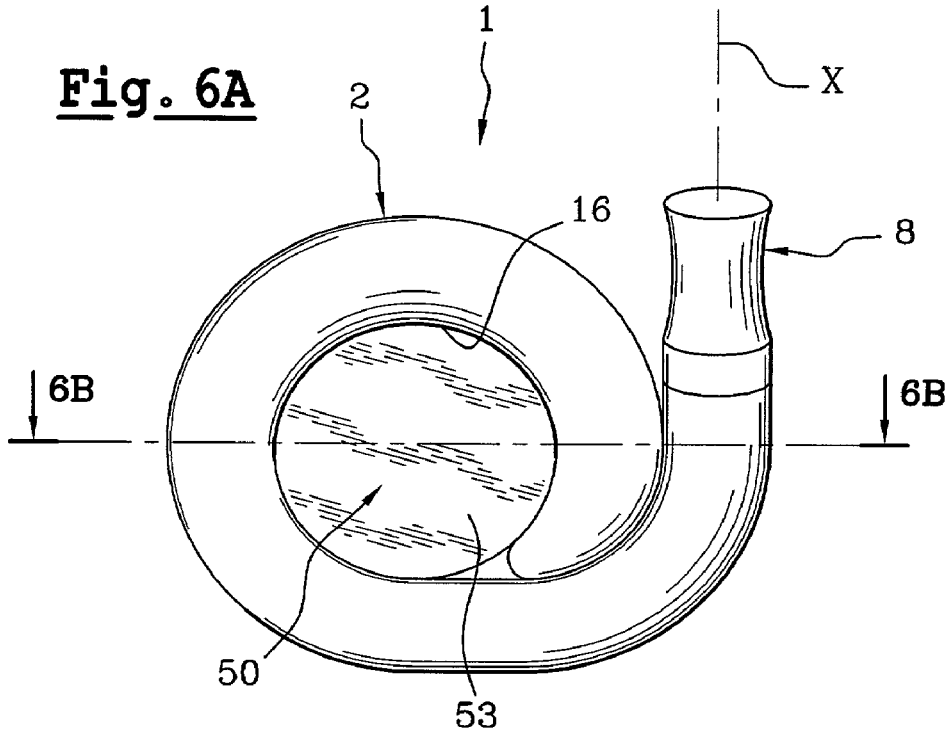
FIG. 6A is a perspective view of the unit according to a further exemplary embodiment of the invention.
Figure 6B:
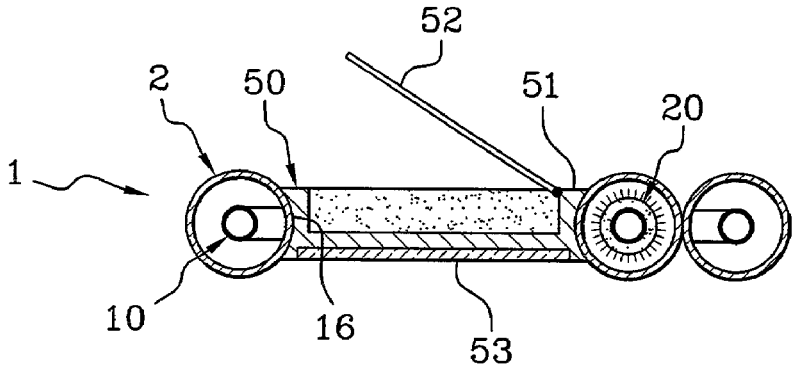
FIG. 6B is a cross-sectional view of the unit of FIG. 6A.

In the embodiment of FIGS. 6A and 6B, the curved container 2 extends over about one and a half turns and is arranged in one plane. The curved container 2 may contain mascara for the eyelashes. Other products could also be used. Inside the internal annular edge 16 is mounted, by reversible snap-fastening, an auxiliary container 50. The auxiliary container could also be permanently secured to the container 2.

The auxiliary container 50 contains a compacted powder in the illustrated embodiment. However, the auxiliary container 50 could also be used to contain other products. The products in the container 2 and in the auxiliary container 50 could be the same or different products. The container 50 is configured in the form of a case comprising a body 51 snap-fastened onto the annular edge 16, and a lid 52 hinged to the body. A mirror 53 is bonded onto the bottom of the case 50.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A unit for applying at least one product, the unit comprising:

a container defining a longitudinal axis curved over at least a portion of its length so that at least a portion of the axis defines at least one curve, the container comprising an interior and an opening;

a cap configured to seal the opening;

a flexible stem; and an applicator member at an end of the flexible stem, the applicator member being removably arranged in the interior of the container and being accessible via the opening, wherein the interior of the container is configured to guide the flexible stem substantially along the longitudinal axis when the applicator member is removably arranged in the interior of the container.

2. The unit of claim 1, further comprising at least one product in the container.

3. The unit of claim 2, wherein the at least one product is chosen from cosmetic products, care products, and hygiene products.

4. The unit of claim 2, wherein the at least one product comprises make-up.

5. The unit of claim 1, wherein curvature of the axis is substantially constant along the length of the axis.

6. The unit of claim 1, wherein curvature of the axis varies along the length of the axis.

7. The unit of claim 1, wherein the curve lies substantially in a plane.

8. The unit of claim 1, wherein the applicator member is secured to a first end of the stem and the cap is secured to a second end of the stem opposite to the first end.

9. The unit of claim 1, wherein the stem is hollow.

10. The unit of claim 1, wherein the stem has at least one region of greater flexibility proximate to the applicator member.

11. The unit of claim 1, wherein the applicator member comprises flocking.

12. The unit of claim 1, wherein the applicator member comprises foam.

13. The unit of claim 1, wherein the applicator member comprises a brush comprising a twisted wire core.

14. The unit of claim 1, further comprising a mirror associated with the container.

15. The unit of claim 1, wherein at least part of the container is formed by a method chosen from extrusion, blow-molding, machining, injection-molding, thermoforming, and molding.

16. The unit of claim 1, wherein the container is formed as a unitary part.

17. The unit of claim 1, wherein the container is formed as a multi-component part.

18. The unit of claim 1, wherein the container comprises an attached bottom and an attached neck and wherein the opening is defined by a free edge of the attached neck.

19. The unit of claim 1, wherein the unit is configured so that the applicator member contacts an inner surface of the container during rotational movement of the stem.

20. The unit of claim 1, wherein the interior of the container comprises a longitudinal axis at least substantially the same as said longitudinal axis of the container.

21. The unit of claim 1, wherein the cap is configured to seal the opening to prevent leakage of product from the container.

22. The unit of claim 1, wherein the cap is configured to cover the opening.

23. The unit of claim 1, further comprising a wiping member mounted near the opening, wherein the wiping member interacts with the applicator member at least when the applicator member is withdrawn from the interior of the container.

24. The unit of claim 23, wherein the wiping member comprises an annular element.

25. The unit of claim 24, wherein the annular element has an interior cross-section that is smaller than a maximum cross-section of the applicator member.

26. The unit of claim 23, wherein the wiping member comprises a material chosen from thermoplastic materials, elastomeric materials, and foam materials.

27. The unit of claim 1, wherein at least a portion of the stem is configured in the form of a helical spring.

28. The unit of claim 27, wherein said at least a portion of the stem has contiguous turns.

29. The unit of claim 1, wherein the stem comprises a metal element.

30. The unit of claim 29, wherein the stem further comprises a tubular element and wherein the metal element is inside the tubular element.

31. The unit of claim 30, wherein the tubular element comprises a thermoplastic material.

32. The unit of claim 29, wherein the metal element comprises metal wire.

33. The unit of claim 1, wherein the stem comprises a solid element.

34. The unit of claim 33, wherein the solid element comprises a thermoplastic material.

35. The unit of claim 1, wherein the cap is removably mounted to the container.

36. The unit of claim 35, wherein the cap is removably mounted to the container by one of snap-fastening, screw-fastening, and a system involving ramps.

37. The unit of claim 1, wherein the applicator member comprises at least one of a paintbrush-type brush, a bottle-type brush, an applicator comb, a molded element, a spring, a felt element, a sintered material, and a threaded shank.

38. The unit of claim 37, wherein the sintered material is chosen from thermoplastics and ceramics.

39. The unit of claim 37, wherein the applicator member has reliefs formed on its surface.

40. The unit of claim 39, wherein the reliefs are chosen from the striation type and the diamond-tip type.

41. The unit of claim 1, wherein the container comprises a thermoplastic material.

42. The unit of claim 41, wherein the thermoplastic material is chosen from polyethylenes, polyvinyl chlorides, polyethylene terephthalates, polyamides, polyesters, and polystyrenes.

43. The unit of claim 1, wherein the container comprises a first container and wherein the unit further comprises an auxiliary container associated with the first container.

44. The unit of claim 43, wherein the auxiliary container is located inside the curve defined by the axis of the first container.

45. The unit of claim 43, further comprising a mirror mounted on the first container.

46. The unit of claim 43, further comprising a mirror mounted on the auxiliary container.

47. The unit of claim 43, wherein the auxiliary container is removably mounted to the first container.

48. The unit of claim 43, wherein the auxiliary container is permanently mounted to the first container.

49. The unit of claim 43, further comprising at least one product in the auxiliary container.

50. The unit of claim 49, wherein the at least one product is chosen from cosmetic products, care products, and hygiene products.

51. The unit of claim 49, further comprising at least one product in the first container, wherein the at least one product in the auxiliary container differs from the product in the first container.

52. The unit of claim 49, further comprising at least one product in the first container, wherein the at least one product in the auxiliary container is identical to the product in the first container.

53. The unit of claim 1, wherein the stem is removably arranged in the interior of the container.

54. The unit of claim 53, wherein the stem is configured so that the stem returns to a substantially straightened shape when the applicator member is removed from the container.

55. The unit of claim 1, wherein the interior has a generally tubular shape comprising at least one curve.

56. The unit of claim 55, wherein at least a portion of an exterior surface of the container has a generally tubular shape comprising at least one curve.

57. A method of applying product, comprising:

providing the unit of claim 1;

loading the applicator member with product; and placing the loaded applicator member in contact with at least one of skin, hair, a finger nail, a toe nail, eyelashes, and eyebrows so as to apply product thereto.

58. The method of claim 57, wherein the loading comprises loading the applicator member with at least one of lip make-up, mascara, eye shadow, eye liner, nail varnish, cream, blush, and powder.

59. The method of claim 57, further comprising wiping the applicator member with a wiping member.

60. The method of claim 57, further comprising placing the applicator member in contact with an inner surface of the container.

61. The method of claim 57, further comprising removing the applicator member from the container, wherein the stem returns from a curved shape to a substantially straightened shape during the applicator member removal.

62. The method of claim 57, further comprising inserting the applicator member into the container, wherein the stem becomes curved during the inserting.

63. A unit for applying at least one product, the unit comprising:

a container defining a longitudinal axis curved over at least a portion of its length so that at least a portion of the axis defines at least one curve, the container comprising an interior and an opening;

a cap configured to seal the opening;

a flexible stem; and an applicator member at an end of the flexible stem, the applicator member being removably arranged in the interior of the container and being accessible via the opening, wherein the curve lies substantially in a plane, and wherein the curve extends over an interval ranging from one-fourth of a full turn to three full turns.

64. The unit of claim 63, wherein the curve extends over an interval ranging from one-half of a full turn to one and a half turns.

65. A unit for applying at least one product, the unit comprising:

a container defining a longitudinal axis curved over at least a portion of its length so that at least a portion of the axis defines at least one curve, the container comprising an interior and an opening;

a cap configured to seal the opening;

a flexible stem; and an applicator member at an end of the flexible stem, the applicator member being removably arranged in the interior of the container and being accessible via the opening, wherein the curve defines at least a portion of a helix.

66. The unit of claim 65, wherein the curve extends over at least one-half of a full turn.

67. The unit of claim 66, wherein the curve extends over at least one full turn.

68. A unit for applying at least one product, the unit comprising:

a container defining a longitudinal axis curved over at least a portion of its length so that at least a portion of the axis defines at least one curve, the container comprising an interior and an opening;

a cap configured to seal the opening;

a flexible stem;

an applicator member at an end of the flexible stem, the applicator member being removably arranged in the interior of the container and being accessible via the opening; and a mirror associated with the container, wherein the mirror is located inside the curve defined by the axis of the container.

69. A unit for applying at least one product, the unit comprising:

a container defining a longitudinal axis curved over at least a portion of its length so that at least a portion of the axis defines at least one curve, the container comprising an interior and an opening;

a cap configured to seal the opening;

a flexible stem; and an applicator member at an end of the flexible stem, the applicator member being removably arranged in the interior of the container and being accessible via the opening, wherein the flexible stem is configured to have a curvature similar to the curvature of the longitudinal axis when the applicator member is removably arranged in the interior of the container.

70. The unit of claim 69, further comprising at least one product in the container, the at least one product being chosen from cosmetic products, care products, and hygiene products.

71. The unit of claim 69, wherein curvature of the longitudinal axis is substantially constant along the length of the axis.

72. The unit of claim 69, wherein curvature of the longitudinal axis varies along the length of the axis.

73. The unit of claim 69, wherein the curve lies substantially in a plane.

74. The unit of claim 69, further comprising a wiping member mounted near the opening, wherein the wiping member interacts with the applicator member at least when the applicator member is withdrawn from the interior of the container.

75. The unit of claim 69, wherein the applicator member is secured to a first end of the stem and the cap is secured to a second end of the stem opposite to the first end.

76. The unit of claim 69, wherein at least a portion of the stem is configured in the form of a helical spring.

77. The unit of claim 69, wherein the stem has at least one region of greater flexibility proximate to the applicator member.

78. The unit of claim 69, wherein the cap is removably mounted to the container.

79. The unit of claim 69, wherein the container comprises a first container and wherein the unit further comprises an auxiliary container associated with the first container.

80. The unit of claim 79, wherein the auxiliary container is removably or permanently mounted to the first container.

81. The unit of claim 69, wherein the stem is configured so that the stem returns to a substantially straightened shape when the applicator member is removed from the container.

82. The unit of claim 69, wherein the unit is configured so that the applicator member contacts an inner surface of the container during rotational movement of the stem.

83. The unit of claim 69, wherein the interior of the container comprises a longitudinal axis at least substantially the same as said longitudinal axis of the container.

84. A method of applying product, comprising:

providing the unit of claim 69;

loading the applicator member with product; and placing the loaded applicator member in contact with at least one of skin, hair, a finger nail, a toe nail, eyelashes, and eyebrows so as to apply product thereto.

85. The method of claim 84, wherein the loading comprises loading the applicator member with at least one of lip make-up, mascara, eye shadow, eye liner, nail varnish, cream, blush, and powder.

86. The method of claim 84, further comprising removing the applicator member from the container, wherein the stem returns from a curved shape to a substantially straightened shape during the applicator member removal.

87. The method of claim 84, further comprising inserting the applicator member into the container, wherein the stem becomes curved during the inserting.

* * * * *